United States Patent [19]

Domínguez

[11] Patent Number: 4,501,444

[45] Date of Patent: Feb. 26, 1985

[54] COLLAPSIBLE DOOR WEDGE WITH QUICK RELEASE MECHANISM

[76] Inventor: Edward J. Domínguez, 503 Park Ave., San Jose, Calif. 95110

[21] Appl. No.: 355,969

[22] Filed: Mar. 8, 1982

[51] Int. Cl.[3] ..... E05C 17/54

[52] U.S. Cl. ..... 292/342

[58] Field of Search ..... 292/342, 343, 207, 210, 292/338, 277

[56] References Cited

U.S. PATENT DOCUMENTS

| | | | |
|---|---|---|---|
| 693,740 | 2/1902 | Raether | 292/343 |
| 1,042,329 | 10/1912 | Daniels | 292/243 |
| 1,056,003 | 3/1913 | Burlew | 292/277 |
| 2,122,312 | 6/1938 | Cassion | 292/342 |
| 4,114,936 | 9/1978 | Dominguez | 292/342 |

*Primary Examiner*—Richard E. Moore

*Attorney, Agent, or Firm*—John J. Leavitt

[57] ABSTRACT

A collapsible door wedge characterized by: a channel shaped base member; a channel shaped incline member pivotally attached at one end to an end of the base member; a prop member pivotally attached to the other end of the base member; and a quick release latch mechanism attached to the incline member for retaining the prop member in its propping position. The incline member has a lower surface provided with a pair of downwardly extending stops defining a latching space receptive to an end of the prop member. The latch mechanism includes a shaft extending through a chamber of one of the stops, a striker attached to one end of the shaft, a knob attached to the other end of the shaft, a washer for supporting the latch mechanism, and a spring disposed around the shaft for biasing the striker towards the latching space.

11 Claims, 4 Drawing Figures

COLLAPSIBLE DOOR WEDGE WITH QUICK RELEASE MECHANISM

BACKGROUND OF THE INVENTION

1. Field of the Invention

This invention relates generally to security devices and more particularly to door stops designed to prevent unauthorized entry 2. Description of the Prior Art The use of wedge stops for doors and windows is well documented in the prior art. For example, in U.S. Pat. No. 1,338,205 of Albright an adjustable door stop is described including a bifurcated wedge provided with a screw for adjusting the height of the wedge.

A number of prior art patents disclose wedges which attach to or near a door or window to prevent unauthorized entry through those closures. Some wedges attach to a surface over which the door or window must open, and thus can be used to limit, rather than prevent, the opening of the door or window.

An example of a wedge which attaches near a door to limit its opening is found in U.S. Pat. No. 4,114,936 of Dominguez. In that patent, Dominguez describes a device including a pair of elongated, nestling channel members pivotally attached together at their ends, a prop member pivotally coupled to a lower one of the channel members, and a retaining screw engaged with a threaded bore provided in the upper channel member. The prop member is raised and engaged with the retaining screw to hold the upper channel member in an inclined, wedging position.

While the door wedge device described in U.S. Pat. No. 4,114,936 performs its functions admirably, it cannot be actuated or disabled very rapidly. In a lethargic moment a person might forego its use with possibly dangerous consequences. Even more dangerous would be the situation where a person had to exit very rapidly, such as to escape a fire, and could not disable or close the wedge due to the panic of the moment.

SUMMARY OF THE INVENTION

An object of this invention is to provide a collapsible door wedge which can be opened rapidly and closed even more rapidly.

Briefly, the invention includes: a channel shaped base member; a channel shaped incline member pivotally attached at one end to an end of the base member; a prop member pivotally attached to the other end of the base member; and a quick release latch mechanism attached to the incline member for retaining the prop member in its propping position. The incline member has a lower surface provided with a pair of downwardly extending stops defining a latching space adapted to receive an end of the prop member. One of the stops has a chamber through which a shaft of the quick release latch mechanism extends. The latch mechanism also includes a striker attached to one end of the shaft, a knob attached to the other end of the shaft, a support washer, and a spring disposed around the shaft for biasing the striker towards the latching space.

An advantage of this invention is that the latch mechanism allows the collapsible wedge to be rapidly opened and closed.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
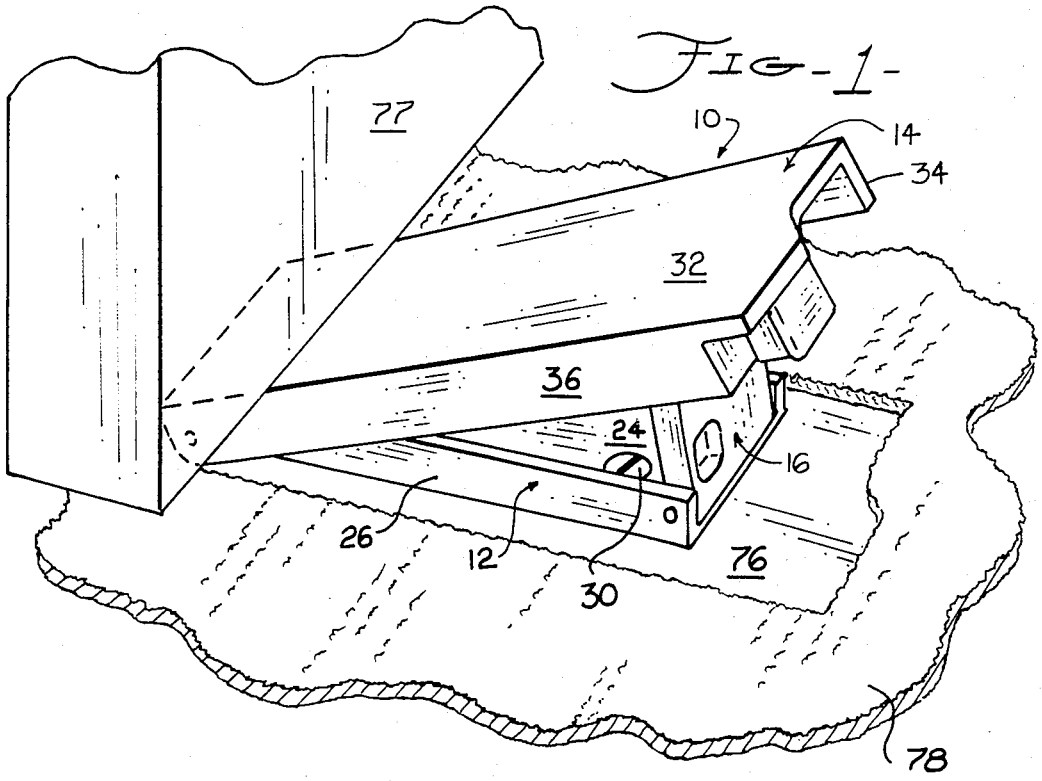
FIG. 1 is a perspective view of the present invention installed in front of a door.
Figure 2:
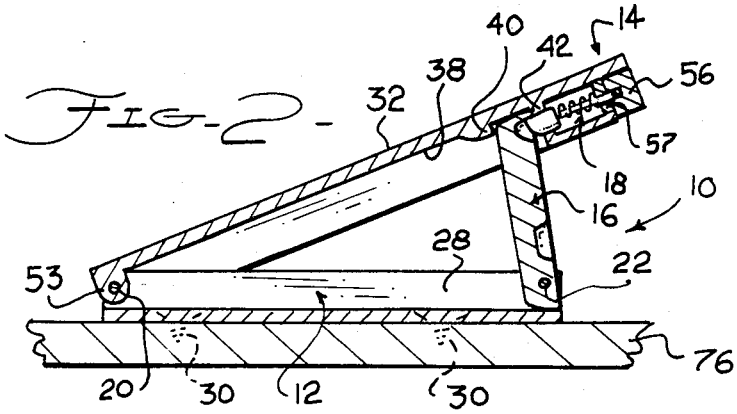
FIG. 2 is a cross-sectional view of the device of FIG. shown in its open, wedging position.

Referring generally to the figures, a door wedge 10 in accordance with the present invention includes an elongated base member 12, an elongated incline member 14, a prop member 16, and a quick release latch mechanism 18. The incline member 14 and the prop member 16 are pivotally attached to the base member by pivot pins 20 and 22, respectively.

The base member 12 is a channel shaped member having a substantially planar base portion 24 and a pair of upwardly extending, parallel sidewall portions 26 and 28. The base portion is provided with a pair of screw holes receptive to screw fasteners 30. The base member, incline member, and prop member are preferably made from a strong, durable material such as anodized aluminum.

The incline member 14 is also substantially channel shaped with a planar top portion 32 and a pair of downwardly depending sidewall portions 34 and 36. The lateral dimensions of the incline member are such that the sidewall portions 34 and 36 fit around the sidewall portions 26 and 28 of the base member so that the base member can nestle within the incline member when the wedge is closed.

The top portion 32 has a lower surface 38 provided with a pair of downwardly depending stops 40 and 42 defining a latching space 44 therebetween. The stop 40 has a substantially vertical face 46 facing the latching space 44, and a sloping, inclined face 48 facing away from the latching space. The stop 42 is larger than stop 40 and includes an internal void or chamber 50 provided with a bore 51 in one of its walls.

The incline member 14 is provided with an endwall portion 53 having a pair of slots receptive to the sidewall portions 26 and 28 of the base member, and an elongated, transverse bore receptive to the pivot pin 20. The ends of pivot pin 20 engage bores provided in the sidewall portions 26 and 28.

Figure 4:
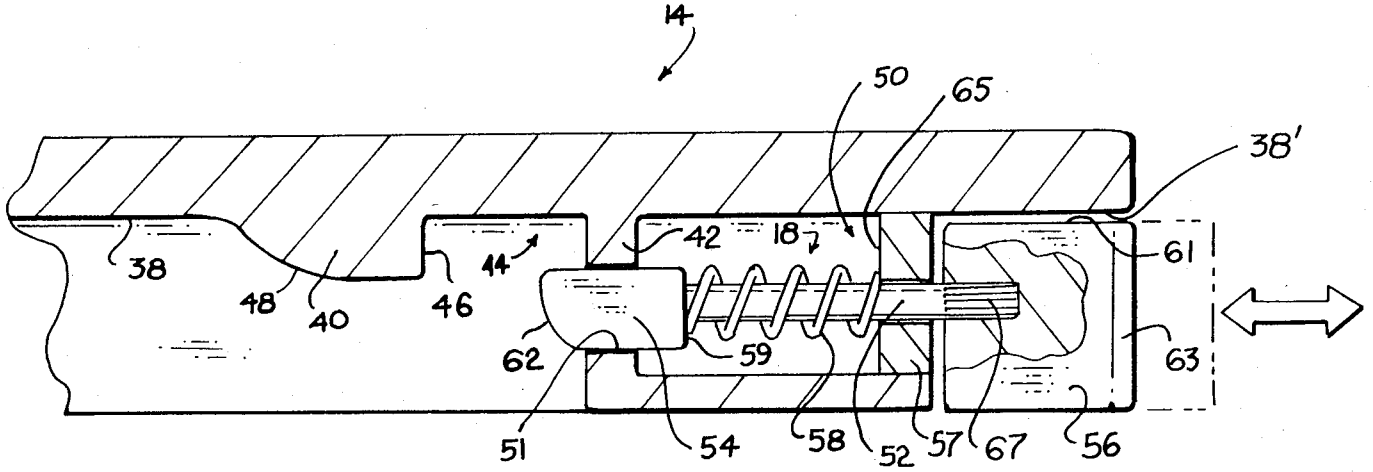
FIG. 4 is a partially cross sectioned and partially broken detail view of the quick release latch mechanism and the lower surface of the incline member.

With specific reference to FIG. 4, the latch mechanism includes a shaft 52, a striker 54 attached to one end of the shaft and extending at least partially through bore 51, a knob 56 attached to the other end of the shaft, a washer 57, and a spring 58 coiled around the shaft 52 to bias the striker 54 towards latching space 44.

The striker 54 has a substantially flat upper surface 60, and a smoothly curved lower surface 62. The striker is preferably attached to the end of shaft 52 by tight press fit. An end of spring 58 abuts a shoulder surface 59 of the striker.

Knob 56 is preferably cubical in shape and includes an upper, planar surface 61 which is guided by a planar portion 38' of lower surface 38. The cubical shape of the knob and its abutment with portion 38' keeps the striker 54 from rotating. The knob is also provided with ears 63 to enhance a user's finger grip on the knob. The knob is attached to shaft 52 by press fitting an end of the shaft into a bore provided in the knob. As shown at 67, the end of the shaft within the bore of the knob can be splined or knurled.

Washer 57 is press fit to the end of chamber 50 and supports the latching mechanism. The washer also provides a shoulder 65 against which the other end of spring 58 can bear. The latching mechanism 18 is assembled by first press fitting the washer to the end of chamber 50, and then press fitting the knob to the end of shaft 52.

Again referring generally to the figures, prop member 16 is a substantially rectangular member having an upper surface 64 provided with a pair of recesses 66 and 68. Recess 66 is configured to engage striker 54 when an upper end 70 of the prop member is disposed within latching space 44. Recess 68 is configured to receive stop 40 when the wedge is closed. Both the upper end 70 and a lower end 72 are rounded from the upper surface 64 towards a lower, opposing surface 74. The rounding of the upper end 70 allows the prop to properly seat within the latching space, and the rounding of the lower end 72 provides clearance from base portion 24 to allow restricted pivotal action of the prop member.

The wedge of the present invention is typically installed to a portion of the floor 76 over which the door 77 opens. The wedge can be recessed into a rug 78, as shown in FIG. 1, or into the floor surface itself When the wedge is collapsed the door is free to swing across the wedge.

To open the wedge, the incline member 14 is grasped near its free end and lifted, and the prop member 16 is elevated and engaged with the latching space 44 of the incline member. A light press on the upper surface of the incline member will cause striker 54 to snap into recess 66 of the prop member.

Figure 3:
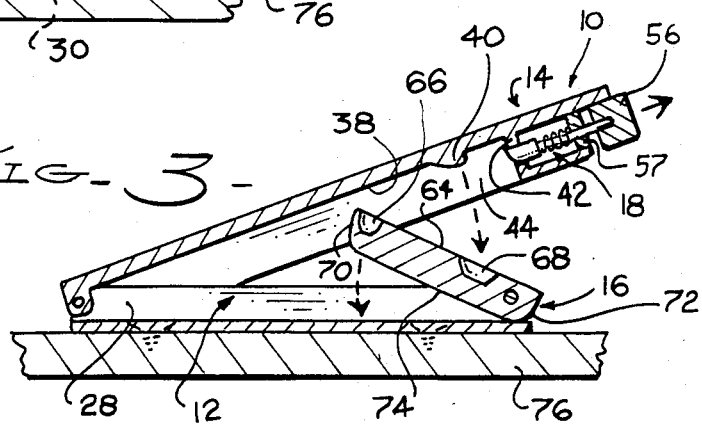
FIG. 3 is the cross-sectional view of FIG. 2 showing the device moving toward its closed, non-wedging position.

To close the wedge, the knob 56 is pulled as suggested in FIG. 3 to free the striker 54 from recess 66. A slight upward lift on the knob will allow the prop member 16 to fall free of stop 40 and thus collapse the wedge. It will be noted that the collapsing of the wedge is a quick, one handed operation easy to accomplish even in the most trying of circumstances.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A collapsible door wedge with quick release mechanism comprising: an elongated base member; an elongated incline member having a lower surface provided with a pair of downwardly extending stops defining a latching space therebetween; means pivotally coupling a first end of said base member to a first end of said incline member whereby said incline member may pivot between a wedging and a non-wedging position; a prop member having a first end pivotally coupled to said base member and a second end configured to fit within said latching space; and a latch mechanism coupled to said incline member including a striker biased towards said latching space and adapted to engage said prop member when said second end of said prop member is within said latching space.

2. A collapsible wedge with quick release mechanism as recited in claim 1 wherein a first of said pair of stops includes an internal chamber, and wherein said latch further includes a shaft extending through said chamber, a knob attached to a first end of said shaft, and biasing means disposed within said chamber for biasing a second end of said shaft towards said latching space, where said striker is attached to said second end of said shaft.

3. A collapsible wedge with quick release mechanism as recited in claim 2 further comprising support means coupled to said incline member proximate said chamber, and wherein said biasing means includes a spring, said support means providing a shoulder against which said spring may bear.

4. A collapsible wedge with quick release mechanism as recited in claim 3 wherein said knob is provided with a planar surface that is guided by a planar surface of said incline member to prevent rotation of said shaft and striker.

5. A collapsible wedge with quick release mechanism as recited in claim 2 wherein a second of said pair of stops includes a substantially vertical face facing said latching space, and an inclined face facing away from said latching space.

6. A collapsible door wedge with quick release mechanism as recited in claim 5 wherein said prop member has an upper surface provided with a first recess receptive to said striker.

7. A collapsible door wedge with quick release mechanism as recited in claim 6 wherein said prop member has an upper surface provided with a second recess receptive to said second stop when said incline member is in said non-wedging position.

8. A collapsible door wedge with quick release mechanism as recited in claim 7 wherein both said first end and said second end of said prop member are rounded from said upper surface toward a lower surface opposing said upper surface.

9. A collapsible door wedge with quick release mechanism as recited in claim 8 wherein said base member and said incline member are nestling, channel shaped members.

10. A collapsible door wedge with quick release mechanism as recited in claim 9 wherein said incline member includes an endwall portion at said first end provided with a transverse bore and a pair of slots engagable with the sidewalls of said channel shaped base member, and wherein said hinging means includes a pivot shaft extending through the bore of said endwall and engaging bores provided in said sidewalls of said channel shaped base member.

11. A collapsible door wedge as recited in claim 10 further comprising means for attaching said base member to a flat, horizontal surface.

* * * * *